US005590846A

United States Patent [19]

Dekel

[11] Patent Number: 5,590,846

[45] Date of Patent: Jan. 7, 1997

[54] SYSTEM AND METHOD FOR MONITORING PROGRESS OF WINDING A FIBER

[75] Inventor: Ehud Dekel, Nofit, Israel

[73] Assignee: State of Israel, Ministry of Defence, Armament Development Authority, Haifa, Israel

[21] Appl. No.: 498,174

[22] Filed: Jul. 5, 1995

Related U.S. Application Data

[63] Continuation-in-part of Ser. No. 83,010, Jun. 24, 1993, abandoned.

[30] Foreign Application Priority Data

Jul. 20, 1992 [IL] Israel ..... 102559

[51] Int. Cl.[6] ..... B65H 57/28; B65H 54/00

[52] U.S. Cl. ..... 242/158 R; 242/25 R

[58] Field of Search ..... 242/158 R, 158.2, 242/158.4 R, 25 R

[56] References Cited

U.S. PATENT DOCUMENTS

| | | | |
|---|---|---|---|
| 4,410,147 | 10/1983 | Siebert | 242/158 |
| 4,456,199 | 6/1984 | Seibert | 242/158 |
| 4,570,875 | 2/1986 | Buluschek | 242/158 |
| 4,928,904 | 5/1990 | Watts | 242/158 |
| 5,009,373 | 4/1991 | Hester | 242/158 R |
| 5,110,065 | 5/1992 | Cawelti et al. | 242/158 R |

*Primary Examiner*—William Stryjewski
*Attorney, Agent, or Firm*—Kohn & Associates

[57] ABSTRACT

A system for the monitoring and, when required, correcting, the winding of a filament pack of an essentially transparent optical fiber on a bobbin, and a method for effecting such winding. The system comprises a conventional filament winding device combined with an of indirect illumination of the fiber for projecting on a screen an enlarged silhouette of the uppermost layer of such filament as it is wound under controlled tension onto the bobbin, and a mechanism for interrupting such winding and effecting corrections whenever required. There may be provided a mechanism for automatically following the progress of the winding so as to maintain the silhouette in the filed of view on the viewing screen.

7 Claims, 4 Drawing Sheets

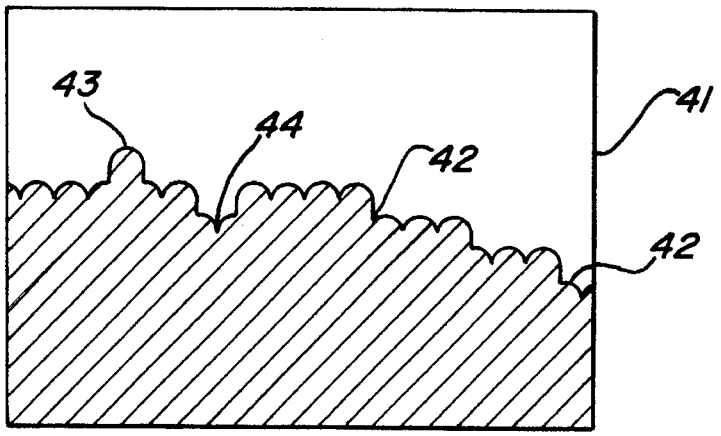
Fig - 4
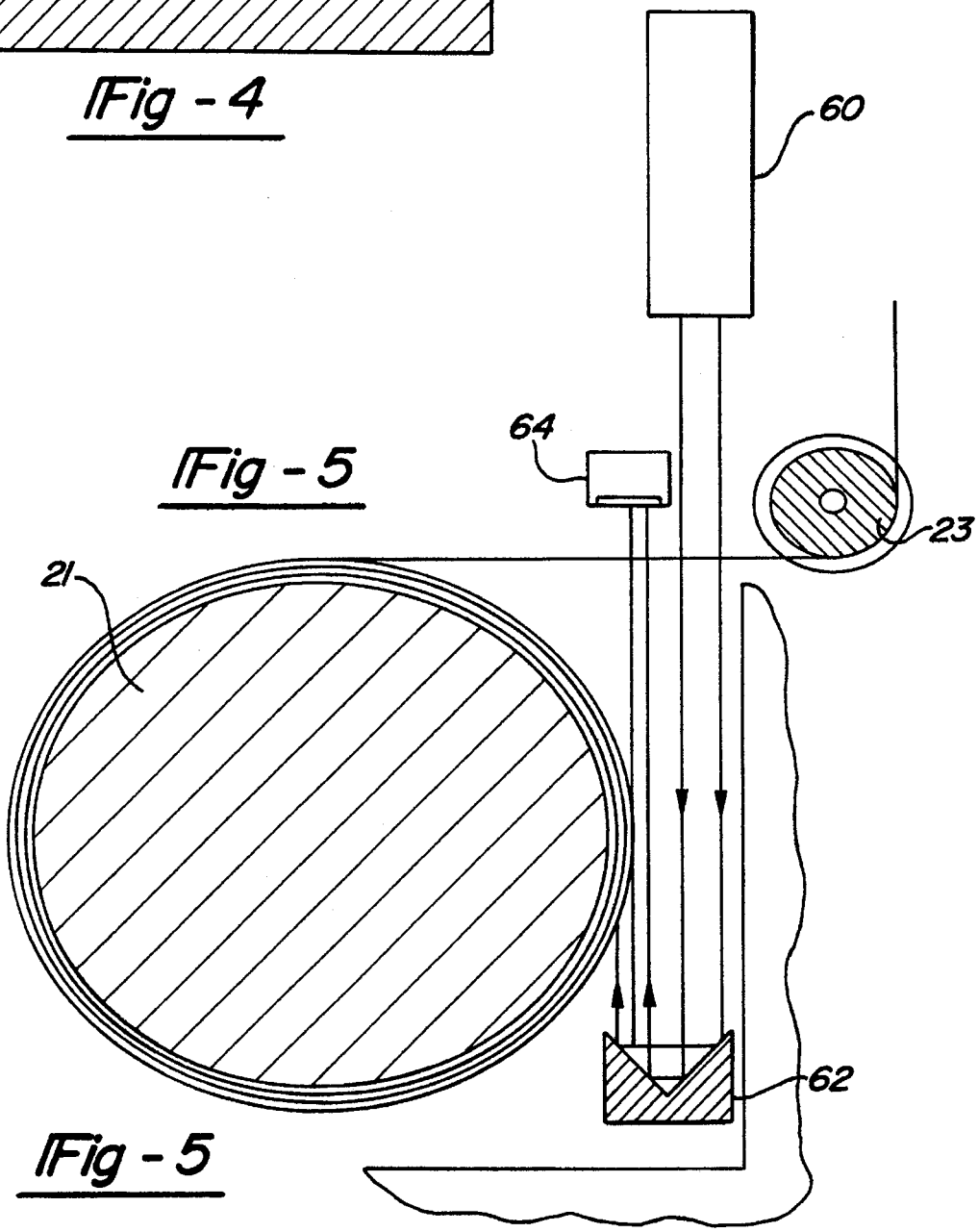
Fig - 5
Fig - 5

SYSTEM AND METHOD FOR MONITORING PROGRESS OF WINDING A FIBER

The present application is a Continuation in Part (CIP) application of patent application Ser. No. 08/083,010 filed on 24 Jun. 1993, now abandoned.

FIELD OF THE INVENTION

For a variety of applications it is necessary to wind a filament, which term is used herein to designate an essentially transparent optical fiber of a diameter in the 0.1 to 0.05 mm range, on a bobbin, in a highly orderly manner. One reason for this requirement is to make possible the rapid unwinding of the filament from the bobbin.

Winding in an orderly manner for this purpose means:

a) The filament wound onto the preceding layer is positioned in the space between adjacent windings;

b) The angular location of filament transition from layer to layer is exactly determined;

c) The exact number of step-back turns between the end of a preceding layer and the beginning of a new layer is determined;

d) Cross-over points of successive turns are kept tightened to each other;

e) Angular location of the beginning points of cross-over lines (formed by the plurality of cross-over points tightened together), is exactly determined;

Applying an adhesive to the wound layers to maintain fiber pack stability and regulate the pay-out process. Such winding operation is done using a winding machine which includes:

a) Means for rotating the bobbin being wound. Means for supplying/collecting the wound filament from a supply reel at a determined tension; Means for moving the fiber feed pulley parallel to the bobbin as winding proceeds and to reverse this movement as a new layer is being wound;

d) Means for applying an adhesive to the uppermost wound layer or to the filament on it's way to the spool.

One of the applications is a communication link between unmanned aircraft, or various types of missiles and glide bombs and a launcher, using for this purpose an essentially transparent optical fiber or a metal wire. The diameter of these is generally in the range of from about 0.1 mm to about 0.5 mm, and as the winding is carried out at high speeds, and as optical fibers are transparent and reflective it is hard to monitor the progress of the winding operation by the naked eye. Operators tire after some time and mistakes are apt to remain unnoticed. When this happens, long lengths of filament, already wetted with adhesive, need to be unwound and returned to the supply spool, a process which wastes time and contaminates the winding machine pulleys. It is not possible to use direct illumination of the fiber, and indirect illumination is used for obtaining a clear silhouette.

The present invention provides a system and a method for the monitoring of the winding operation of a filament, of the type defined above, on a bobbin, and this by means resulting in the projection of the silhouette of the wire winding onto a viewing screen, which makes possible a real-time control of the winding process, and reduces the need to return long lengths of filament to the supply spool.

It is stressed that one of the main features of the present invention is the fact that it deals with the monitoring of the winding of an essentially transparent optical fiber which is wound on a tapered bobbin. There cannot be used direct illumination, and thus indirect illumination is required, which is obtained by the use of a light source, while the critical area of the fiber pack is shaded from direct illumination. The optical fiber passes through the field of view of the optical system, out of focus of this system, and as the diameter of such fiber is in the 0.1 to 0.5 mm range, generally about 0.3 mm, it does not disturb the formation of a sharp image of the silhouette of the critical part of the fiber pack, where the fiber is being wound.

As such fiber packs are used mainly for the control of missiles, the unwinding must be rapid and for this purpose there is provided between adjacent layers of the fiber on the bobbin, a very thin adhesive layer.

BACKGROUND OF THE INVENTION

U.S. Pat. No. 4,570,875, Buluschek, monitors the winding of a rope, or cable, by means of a motor, onto a wheel. He uses direct illumination.

U.S. Pat. No. 4,456,199, Seibert, monitors the winding of a strand-shaped winding material and provides computerized means for ascertaining at every instant the relative position of the spool respective the strand guide. Also this system differs in many aspects from that of the invention, and cannot be used with transparent optical fibers of the 0.3 mm diameter range: also this patent uses direct illumination.

U.S. Pat. No 4,410,147 Seiber, deals with a control device fro obtaining a uniform winding a strand shaped material, based on an electrical scanning device which detects the transition from a winding layer to the next one by detecting the step that is formed during such transition. Opto-electrical or acousto-electrical means are used.

U.S. Pat. No. 4,928,904, Watts, deals with the monitoring of the winding of an optical fiber, but his method is based on the introduction of light into the optical fiber, where it undergoes internal reflections, detecting the position of the illuminated portion of the fiber. The Watts Patent demonstrates in a clean manner that he did not arrive at the simple indirect illumination of the fiber, as is done according to the present invention, but resorts to the internal illumination of the fiber. He does not form a silhouette and does not use indirect illumination, and thus his monitoring is based on entirely different principles.

SUMMARY OF THE INVENTION

There is provided a system and method for monitoring the winding of a transparent filament on a bobbin, by visual inspection of an enlarged image. Such system and method is of special use with filaments (optical fibers) of the order of 0.1 mm to about 0.5 mm diameter. The system comprises means for selectively illuminating the background behind the fiber pack to form by indirect illumination a silhouette of said pack, a mechanical support adjusted to follow the newly wound fiber layer, an optical device mounted on said support to relay an image of said silhouette to a photosensitive sensor such as a CCD (computer controlled display), also mounted on said support, and a TV monitor for viewing said image and following the progress of the winding operation.

This system makes possible the observation of the outline of the surface of the fiber pack as it is wound on the bobbin, in enlarged size, so that the uppermost layer of the fiber spool and its lateral ends are clearly visible. This makes possible the continuous monitoring of the winding process, and to discern immediately when an irregularity occurs. Such irregularities are generally a superfluous winding, or the skipping of a required winding. This enables the operator to stop the winding and take any action required to remedy the irregularity. The bobbins onto which such fibers are wound are generally of a tapered shape, and thus there must be provided means for maintaining the optical system axis tangent to the fiber pack outline as the winding proceeds. This can be attained by providing a mechanical guide, inclined to the bobbin axis by an angle equal to the bobbin taper angle, which shifts the optical system towards the bobbin axis as winding proceeds from the bobbin's large diameter end to the small diameter end and vice versa. As winding proceeds the fiber pack diameter increases. To keep the fiber pack outline in the field of view, means for moving the optical system relative to the mechanical guide is provided. Since the fiber is transparent and its outer surface is reflective, special illumination is needed to create a silhouette; a suitable arrangement is provided.

The correct illumination is achieved by:

a) Shading the fiber pack area viewed by the optical system from direct light;

b) Providing a dark background behind the fiber pack;

c) Providing a narrow bright strip (such as a white paper or some kind of dimmed light source) oriented parallel to the spool silhouette and located behind the fiber pack outline with respect to the optical system. This strip may be stationary or connected to the optical system and moving axially and radially with it.

Automatic evaluation means can be optionally incorporated into the system of the invention, for evaluating the image of the outline (silhouette) of the fiber pack as it is being wound on the bobbin. This is advantageously done by video signal processing techniques, and such evaluation can be used for stopping the winding as soon as an irregularity is discerned.

For the observation of the silhouette of the fiber spool, which is generally tapered, as it is being wound on a bobbin, a relatively large lens-to-object distance is required and suitable optical means are provided. The following are typical parameters of optical fibers being wound on a bobbin: typical fiber diameters are of the order of 0.1 mm to 0.5 mm, generally up to 0.3 mm. Speed of winding are in the 3 m/sec to 12 m/sec range, the linear progress on the surface of the fiber pack being of the order of I to 10 mm/sec, depending on bobbin and fiber diameter. Onto tapered bobbins fiber spools of up to about 200 layers can be supplied. When one layer is completed, an adhesive is applied which provides rigidity and facilitates orderly unwinding. The fiber is stepped back by one or more windings respective the previous layer, and the next layer is applied.

DESCRIPTION OF THE PREFERRED EMBODIMENT:

The invention is illustrated with reference to the enclosed Figures, which are schematic and not according to size, in which:

FIG. 4 is a typical field of view of the coil silhouette provided by the monitoring system.

FIG. 5 is a cut through the optical axis and the coil being wound in an alternative embodiment of the present invention.

Figure 1:
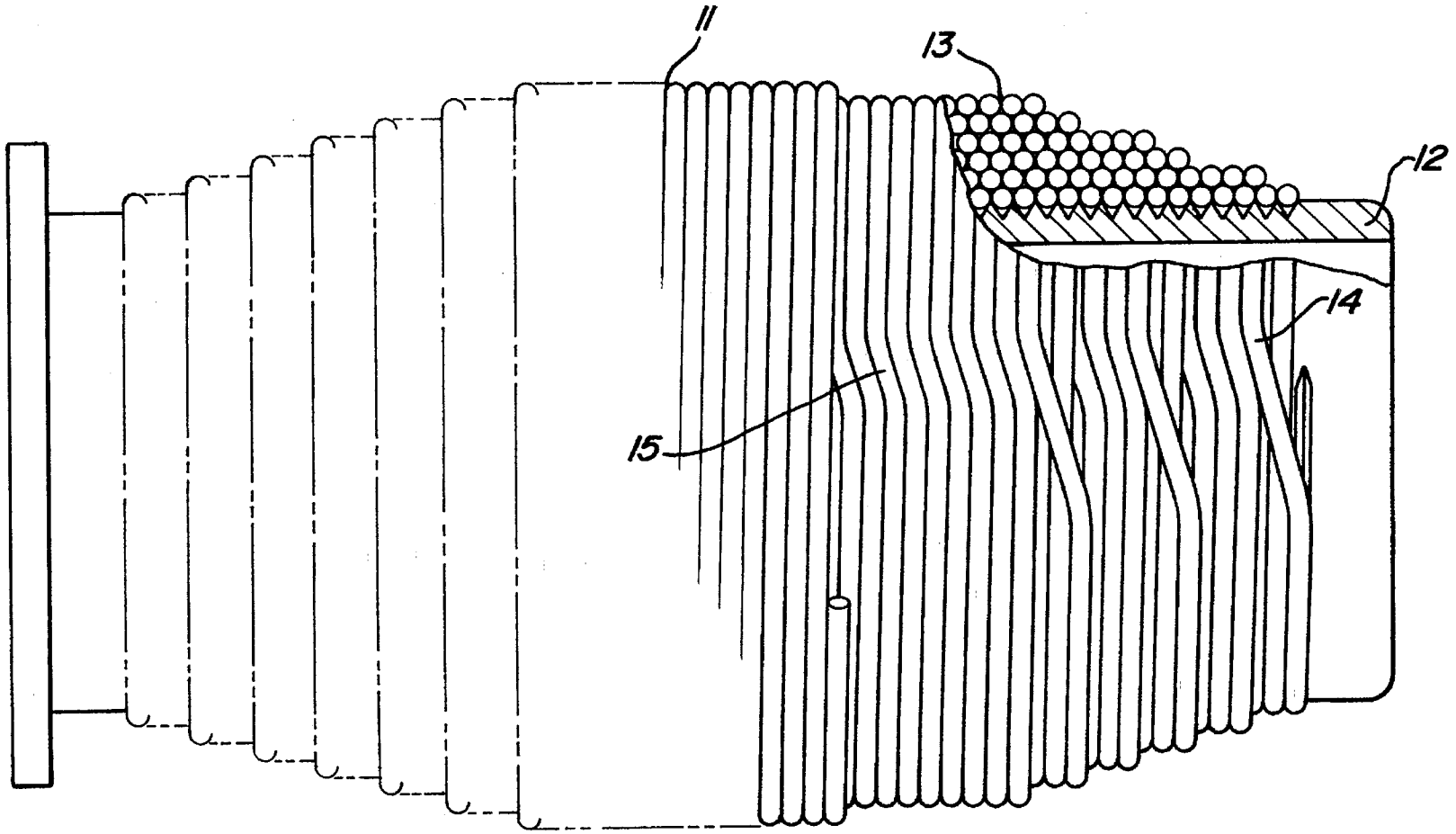
FIG. 1 is a side-view of the wound coil, with a local radial cut.
Figure 2:
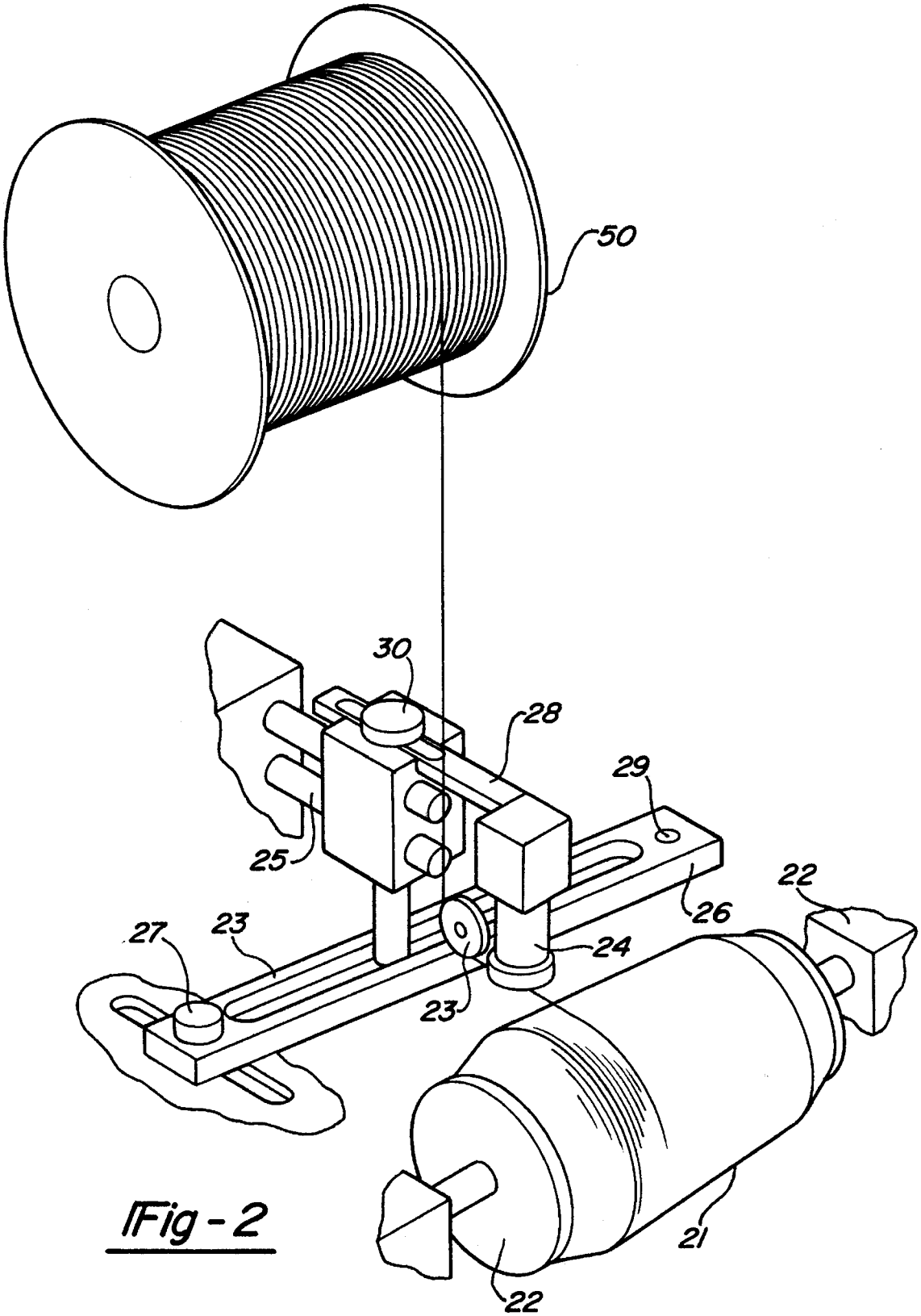
FIG. 2 is an exonometric view of the system of the invention, including the coil being wound, the winding machine and the monitoring system of the invention.
Figure 3:
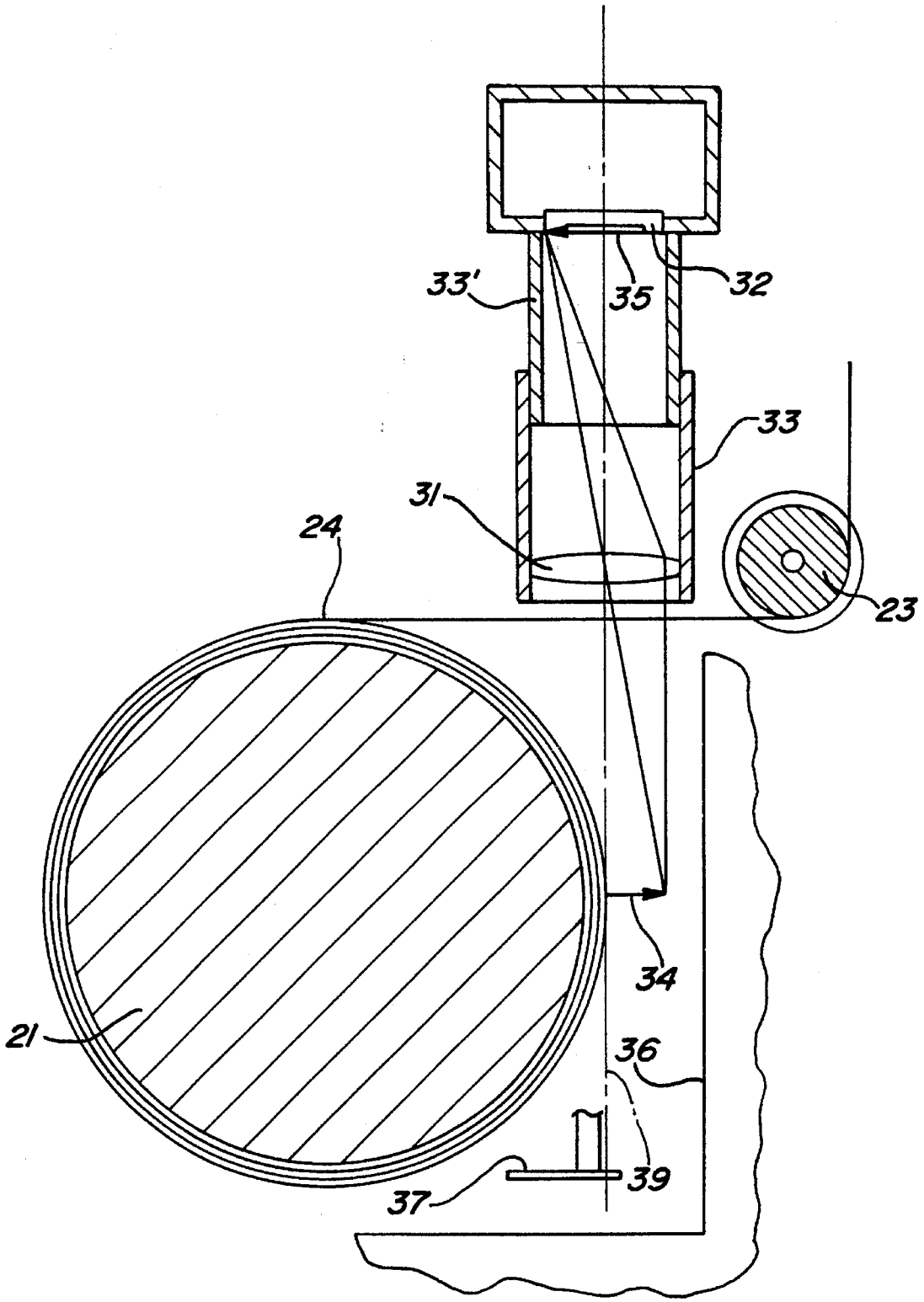
FIG. 3 is a cut through the optical system axis and the coil being wound.

As shown in FIG. 1, the fiber spool 11, shown in partial section, comprises a bobbin 12, on which there is wound a fiber spool 13, where the fiber is wound in a staggered arrangement, with the ends of the windings in upper layers being set back respective lower ones by a number of windings. After each fiber layer, a coating of adhesive is applied, and the fiber is brought to the starting point of the next winding, and the next winding is wound on the underlying one, and so on. In this FIG. 14 is a cross-over point and 15 defines a cross-over line. In FIG. 2, there is shown a fiber spool 21, mounted on the winding machine 22 (shown in part), where there is provided a supply pulley, which guides the winding of filament 24 from a supply reel 50 onto the bobbin. A typical length of the fiber spool is about 100 to 400 mm, with a diameter of about 100 to 200 mm. The entire device 23, has the purpose to monitor the silhouette of the fiber spool as it is being wound onto the bobbin, with the field of view following the filament as it is being wound. This comprises an optical system 24', shown in detail in a following Figure, a sliding support 25, a mechanical guide 26, an adjustment screw 27, adjustable support 28, and a pivot 29. There is provided a screw 30, which permits adjustment of the field of view of the optical system. As the filament is fed to the winding mechanism over supply pulley 23, the optical applied to the bobbin, or lower layer of wound filament, taking into consideration the speed of winding and the tapering of the bobbin. The result is the projection of the enlarged image of the silhouette onto a CCD, from where the image is projected onto a TV-screen or the like. As shown in FIG. 3 a filament 24 is wound via supply pulley 23, under controlled tension, onto bobbin 21, there being provided an optical system comprising a relay lens 31, a CCD 32, focusing tubes 33 and 33', where the arrow 34 depicts an object in the field of view of the optical system, the image 35 of which is obtained on the photosensitive surface of the CCD 32, there being provided a dark background 36 and a support 38 of a bright strip 37. The filament 24 passing through the optical system field of view does not interrupt forming the winding silhouette image, since it passes far from the system's focal plane. FIG. 4 is an illustration of an image obtained by means of the system of the invention on the TV-screen, 41. It can be seen that successive layers are wound with step-back turns 42, for each successive layer. In this image 43 shows a superfluous winding, and 44 a missing one. When a winding is missed it is possible to go back to the missing one and recommence winding, and the same applies in the case of one or more superfluous windings. Various arrangements of optical systems and imaging can be resorted to, providing a silhouette of the outermost layers of the windings, without departing from the present invention. An example of a system shown in FIG. 3 comprises a CCD with 6.6 by 8.8 mm sensitive area, mounted in a TV camera, there being provided an optical relay lens of 50 mm focal length, with it's focal plane spaced 50 mm from the CCD surface, which provides a 1:1 image of the coil silhouette on the CCD surface. A typical f number is 16 to 22. referring to FIG. 5, an alternative embodiment of the present invention is shown. In this embodiment, a source of collimated light 60, means 62 for directing the collimated light onto the edge of the fiber pack being wound onto a bobbin, and a photosensor 64. The relative position of the components are such that the photosensor 64 is partially shaded from the light beam by the outline of the wire pack.

I claim:

1. A system for monitoring the progress of the winding of a transparent optical fiber pack of a fiber of a diameter of 0.1 mm to 0.4 mm on a bobbin, comprising a winding device where the optical fiber is supplied from a supply reel at a determined tension to which there is attached an optical system which comprises a lens system which projects an enlarged image of the silhouette of the outermost fiber layer onto a CCD operatively connected to a TV screen, and then to the TV screen for viewing the silhouette images, means for shielding the bobbin from direct light by a dark background adjacent the fiber pack, a bright strip oriented parallel to the bobbin silhouette, located behind the fiber pack outline respective the optical system, means for operably tracking the movement of the fiber ending, operably connected to the optical system such that the optical system progresses along said bobbin, so as to provide the image of the said silhouette in a field of view during the winding procedure, where said optical fiber passes through the field of view of the optical system, out of focus of the optical system so as not to disturb the formed image, means enabling an operator to stop the winding in case of any irregularity of the winding, enabling the operator to correct any such winding defect, said system comprising means for the application of a thin layer of an adhesive to each fiber layer after each fiber layer is applied to the bobbin, and for repeating such application of further layers until the desired number of fiber layers is obtained.

2. A system according to claim 1, where a bright background is provided for viewing a contour of the fiber pack as it is being wound on the bobbin.

3. A system according to claim 1, where said means for operably tracking includes a mechanical guide parallel to the spool outline.

4. A system according to claim 1, where said means for operably tracking includes one or more computer controlled motor driven positioning devices.

5. A system according to claim 1 where means are provided for automatically evaluating the photo sensitive sensor output indicating any winding fault.

6. A system according to claim 1, further comprising a source of collimated light, means for directing the collimated light onto the edge of the fiber pack being wound on a bobbin, and a photosensor, the relative position of components being such that the photosensor is partially shaded from said light beam by the outline of the wire pack.

7. A method for monitoring the progress of the winding of a transparent optical fiber pack of a fiber of a diameter of 0.1 mm to 0.4 mm on a bobbin, comprising supplying the fiber to a winding device where from a supply reel at a determined tension, to which there is attached an optical system which comprises a lens system, projecting an enlarged image of the silhouette of the outermost fiber layer onto a CCD operatively connected to a TV screen, and then to the TV screen for viewing the silhouette images, shielding the bobbin from direct light by dark background adjacent the fiber pack, providing a bright strip oriented parallel to the bobbin silhouette, located behind the fiber pack outline respective the optical system, operably tracking the movement of the fiber ending, by means connected to the optical system such that the optical system progresses along the said bobbin, thus providing the image of said silhouette in the field of view during the winding procedure, passing said optical fiber through a field of view of the optical system, out of focus of the optical system so as not to disturb the formed image, so as to enable an operator to stop the winding in case of any irregularity of the winding, enabling the operator to correct any such winding defect, and a thin layer of an adhesive to each fiber layer after each fiber layer is applied to the bobbin, and repeating such application of further layers until the desired number of fiber layers is obtained.

* * * * *